United States Patent [19]

Sartori

[11] Patent Number: 4,557,011

[45] Date of Patent: Dec. 10, 1985

[54] FIXTURE TO SUPPORT ADHESIVE PAPER ROLLERS ON ROLLER BRUSHES FOR DUSTING CLOTHING ARTICLES

[76] Inventor: Francesco Sartori, Via S. Felice 44, Bologna, Italy

[21] Appl. No.: 497,860

[22] Filed: May 25, 1983

[30] Foreign Application Priority Data

May 25, 1982 [IT] Italy ..... 4921/82[U]

[51] Int. Cl.[4] ..... A47L 25/00

[52] U.S. Cl. ..... 15/104 A; 15/230.11; 242/55.2

[58] Field of Search ..... 15/104 A, 230, 230.11; 242/55.2

[56] References Cited

U.S. PATENT DOCUMENTS 4,361,923 12/1982 McKay ..... 15/104 A 4,422,201 12/1983 McKay ..... 15/104 A

*Primary Examiner*—Chris K. Moore

*Attorney, Agent, or Firm*—Cushman, Darby & Cushman

[57] ABSTRACT

A device for removing dust and lint from clothing using adhesive coated rollers includes a pair of disc-like supports for the roller and are supported on a shaft. A second pair of disc-like members are also provided on the shaft positioned outwardly from the first pair of discs. The second pair of discs are slightly larger than the first pair and the inner diameter of the roller but smaller than the outer diameter of the roller. A handle is contiguous with one of the larger discs while the other is provided with a transverse slit allowing elastic deformation of the two halves of the disc for installation and removal of the roller. A protective tubular sheath having an inner projection is slid over the roller to where the transverse slit receives the inner projection.

6 Claims, 3 Drawing Figures

Figure 1:
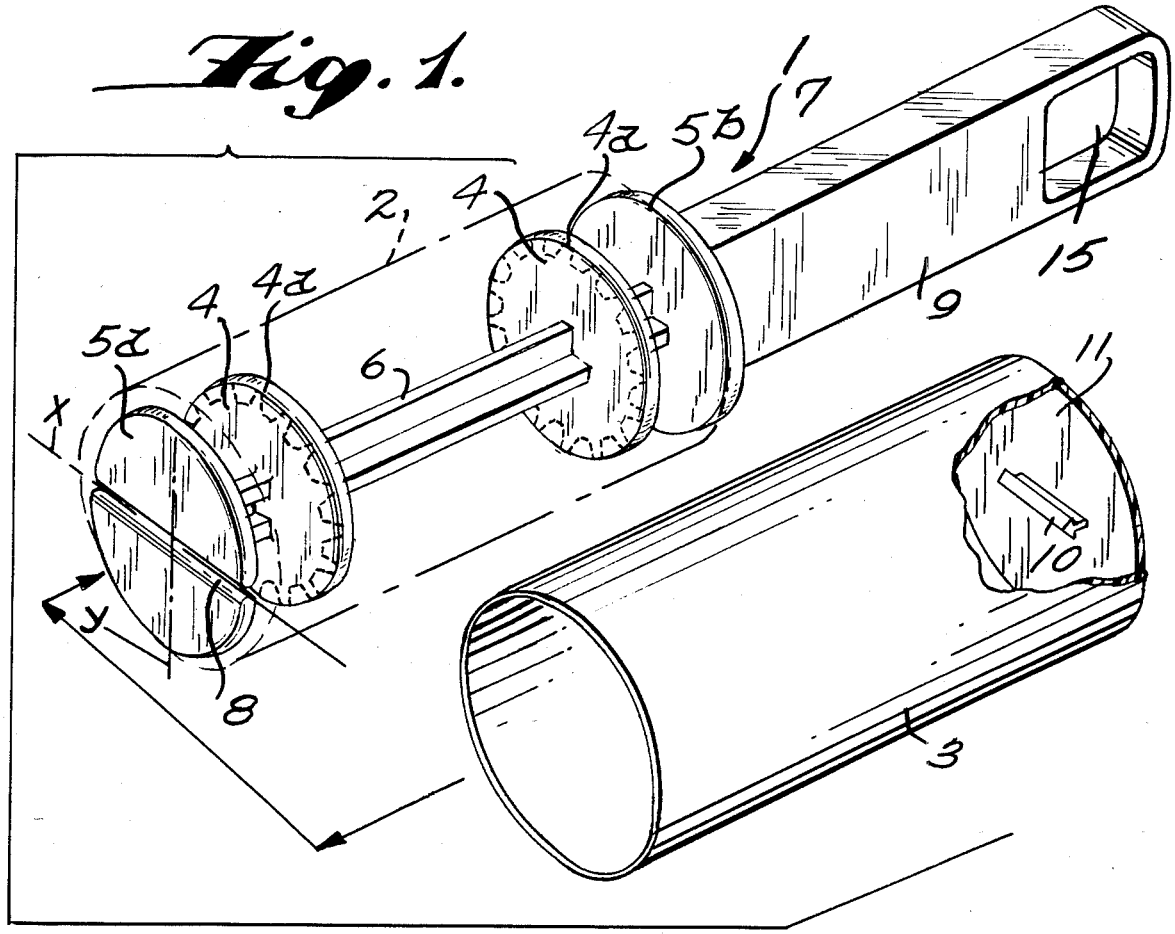

FIXTURE TO SUPPORT ADHESIVE PAPER ROLLERS ON ROLLER BRUSHES FOR DUSTING CLOTHING ARTICLES

DESCRIPTION OF THE INVENTION

This invention consists of a fixture to support adhesive paper rollers for roller brushes used to dust clothing articles.

Fixtures used to support these types of rollers are well known and are classifiable under different types.

One type of fixture includes an element shaped like a pole containing a handle on which can be placed two or more annular elements with cylindrical crowns in support of the roller's movement. This pole like element has at its forward extremety a wedge-shaped head which is placed in the annular element whose function is to support the forward portion of the roller.

In order to remove or substitute a roller from the fixture it is necessary to exert manual pressure on this annular element so as to disconnect the wedge-shaped head from its position causing, as a result, the breakdown of the fixture in its various parts. These parts are to be reassembled when a new roller is to be used.

A second type of fixture has a cylinder shaped body with a diameter slightly smaller than the roller's internal diameter mounted, in idle fashion, on a shaft with a handle. This shaft has a ledge placed near the handle as well as an expandable elastic head at its free end which prevents the cylinder shaped body from sliding off the shaft during the use of the fixture.

Even in this case it is necessary to exert pressure on the cylinder shaped body to break down the fixture into its various components which are then reassembled when a new roller is applied.

A third type of fixture for the support of rollers is composed of two bodies fastened with each other so as to be placed in a position whereby they form a closed cylinder shaped body that holds the roller as well as in a position in which they are partially superimposed leaving the adhesive paper roller partially free. Support for the roller is obtained by means of cylinder shaped crown or shell-like bodies integrated with the pins. In order to remove the roller from the fixture it is necessary to apply pressure on the lateral walls off the shell-like bodies in order to alter their appearance and shape and remove the cylindrical crowns or pins from the extremity of the roller.

The first and second type of fixture described above of rather complex construction and the fact that they are made up of several different parts renders the process of changing the adhesive paper roller a cumbersome one.

Often, the manual process of removing the roller is difficult, especially when the various components come apart unexpectedly.

The third type of fixture, even though resolving the problem of covering and protecting the roller during periods of non-use, is still rather complex design; furthermore, the elastic deformation of the shell-like lateral walls requires the use of both hands on the part of the operator which means that he cannot at the same time remove the roller from the fixture.

The purpose of this invention is to avoid the above mentioned inconveniences. In particular, its purpose is to provide a fixture for the support of adhesive paper rollers on roller brushes used to dust clothing articles consisting of one piece on which and from which a roller can be easily put on and taken off. This invention also allows the application, with great ease, of a protective cover for the roller mounted on the fixture.

One other purpose of this invention is to provide a fixture that is easily manufactured and is therefore relatively low in cost.

In essence, the major characteristics of this invention are as follows: at least one couple of elements in support of the rotary movement of the roller of a form and section so as to be inscribed in a circumference of a diameter smaller than the roller's internal diameter; a couple of ledges, coaxial with the above mentioned support elements, with a distance between them a little longer than the roller's length and with a form and section superior to the interior section of the roller and inferior to the roller's external section; these support elements and ledges are solidly connected by a stem-like element coaxial with them and to which a handle is connected; the fixture has a ledge positioned at the extremety in such a way as to not interfere with the handle and a transveral slit that divides it into two parts along the stem-like element.

The lack of detached parts simplifies the process of substituting the roller to the point that all that is required is to hold the fixture by the handle and work on the roller until it slides from the ledge which is positioned on the free side or on the other side from where the handle is located.

This process is further simplified by the fact that, usually, the rollers are made of cardboard and, therefore, easily changeable in shape as well as the fact that the ledge is elestically deformable when the roller is pushed against it.

The availability of a cylindrical sheath covering the roller and mounted on the fixture allows for a high maneuverable brush and prevents the adhesive paper from coming in contact with other objects.

Figure 2:
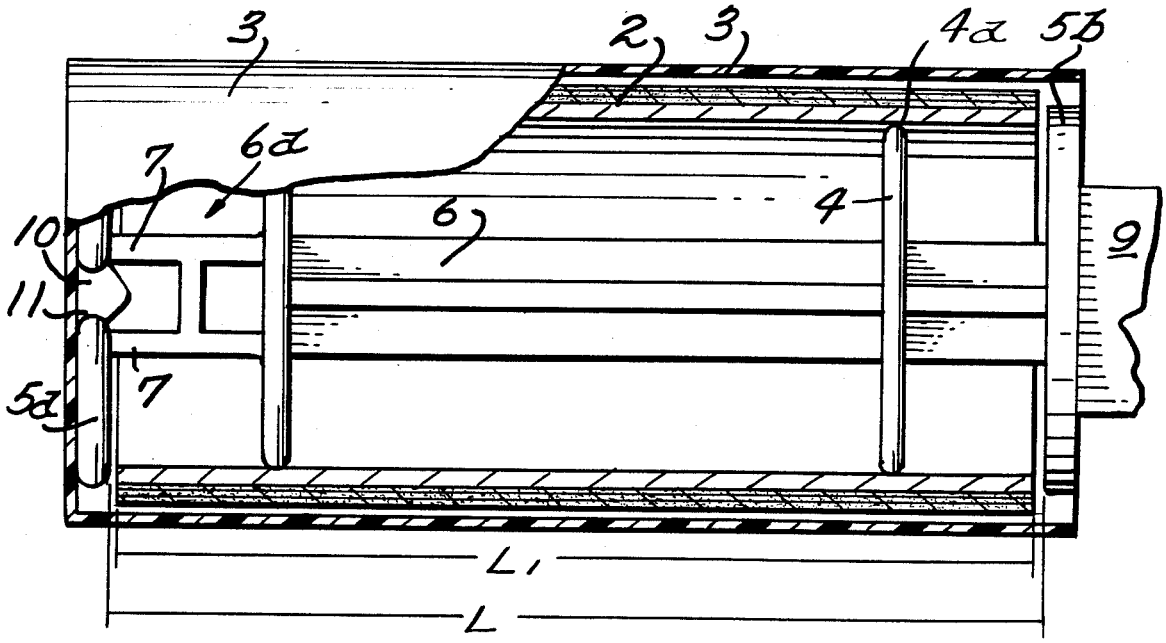
Figure 3:
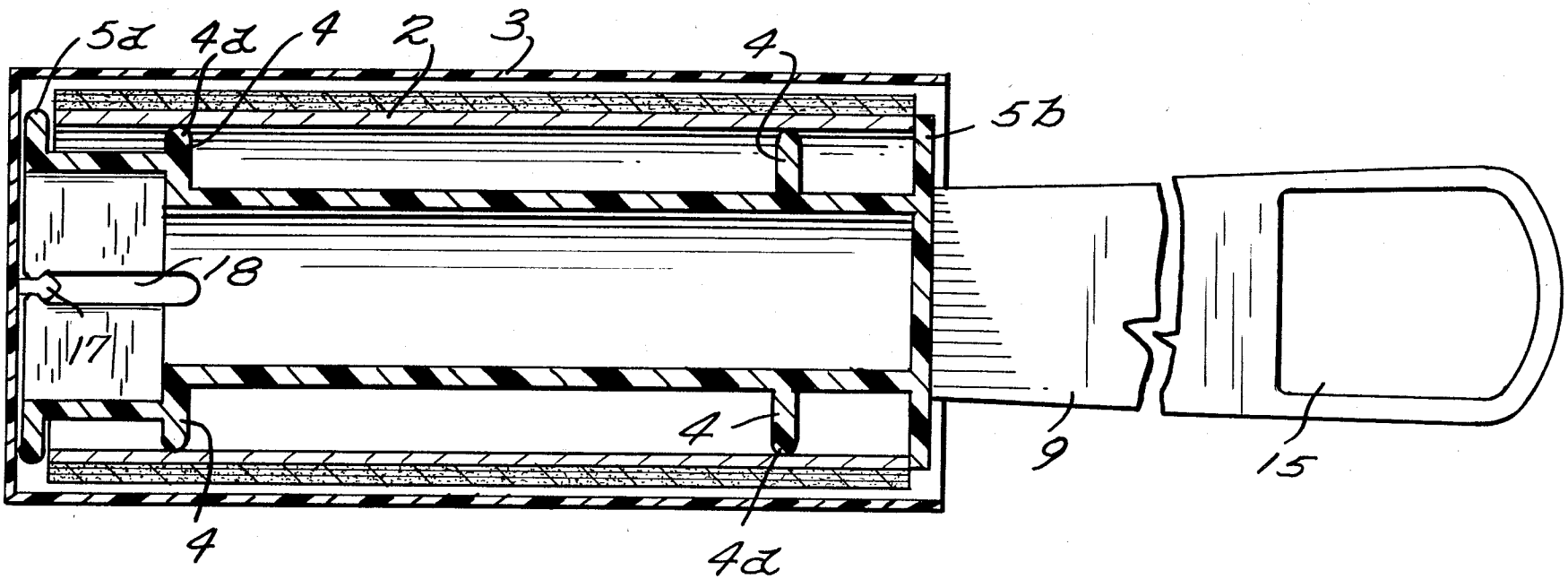

The characteristics of this invention will now be described in more detail in conjunction with the enclosed drawings and based on one of its applications:

FIG. 1 presents the fixture with the protective sheath removed;

FIG. 2 presents, in larger scale, a side view of the fixture with all of its parts and with the protective sheath on;

FIG. 3 shows in side view the fixture with all its parts in one of its applications.

In reference to these figures, particularly FIGS. 1 and 2, the fixture itself is indicated with the numeral one (1), which the roller is indicated with 2 and the protective sheath with number 3.

The roller 2 is indicated only by a discontinued line in that it is not itself part of the invention being discussed here; therefore, it is not discussed in any detal.

It is only pointed out that the roller is made of a series of adhesive paper sheets wrapped one after the other on a cardboard tube with the adhesive area on the outside part of the roller.

Fixture 1 consists of two disc shaped elements 4 which, with their borders 4*a*, form the support area for the roller 2. In the case shown, the borders 4*a* of the discs 4 appear round; one of the applications of this invention has the borders 4*a* with a series of cuts that reduce the area of contact with the roller 2 to a series of points separated between them in order to render the roller's movement freer with respect to the fixture.

5*a* and 5*b* represent two ledges, also shaped discs, coaxial with the support elements 4 and facing towards them on the outer side, with the internal areas apart from each other by a distance L slightly longer than length L1 of the roller 2.

Support elements 4, and ledges 5*a* and 5*b* are solidly connected by a stem shaped element 6 consisting of a pole whose forward portion 6*a* is defined by two lever arms 7, flexible, more description of which to follow later.

Ledge 5*b*, which from now on will be identified as the rear ledge, is of circular form and has a diameter larger than the roller's 2 internal diameter but smaller than its external diameter. Ledge 5*a*, later to be know as the forward ledge, is ellipsoidal in shape with its minor axis X of a length less than the internal diameter of the roller and with its major axis Y of length longer than the diameter.

Forward ledge 5*a* shows, together with axis X, a slit 8 which divides element 5*a* into two parts. This slit extends itself to the stem shaped element 6 in such a way as to define the arms lever 7 and which in turn sustain the removed parts of forward ledge 5*a*.

This element 5*a* is elastically deformable in the direction of axis Y in such a way as to be able to slide into the roller 2 during the mounting stage of the roller onto the fixture as well as to come off when the roller has to be replaced. In order to facilitate this operation the borders of the forward ledge 5*a* are rounded.

The number 9 identifies a handle used to manually hold the fixture 1 and it includes a slot 15 for hanging it. This handle is integral with the rear ledge 5*b*.

By holding the fixture with handle 9, placing the roller on the clothing article, and moving it back and forth, the roller 2 rests on support elements 4 and with its adhesive external surface picks up foreign matter from the clothing. When the adhesive surface needs replacing, it is simply unraveled from the roller and replaced with a new one. When the roller needs replacing, it can slide off the fixture with minimal effort as a result of arms 7 flexing and forward ledge 5*a* bending.

As mentioned earlier, tubular element 3 is used as a cover for the roller 2. The tubular element is fixed on the fixture 1 by means of a protruding part 10 found on the head 11 of the tubular element and shaped in such a way as to be able to fit into the slit 8. In order to facilitate this operation, the walls formed by slit 8 on the ledge 5*a* are undercut and are diverted towards the interior part of the fixture.

FIG. 3 shows a variation on this design of fixture 1. As shown, utilizing the same basic concept of this invention, the stem shaped element connecting support elements 4 with ledges 5*a* and 5*b* is tubular in form and forward ledge 5*a* has many slits 18 which define several flexible arms 17 leading to elastic deformation of the ledge.

I claim:

1. A fixture for supporting adhesive coated rollers used to remove lint from clothing comprising a shaft, at least one pair of disc-shaped support elements for the roller integral with said shaft and having a width less than the inner diameter of the roller and positioned apart from one another distance less than the length of the roller and allowing rotational movement thereon, a set of disc-shaped ledges positioned axially outside the support elements, the ledges having a dimension, radial with respect to the axis of the shaft, which is greater than the inner diameter and less than the other diameter of the roller, the first of said ledges having a handle member integral therewith, the second ledge being elliptical and having a transverse slit extending along the minor axis thereof and dividing the ledge into two equal halves each of which is connected to the adjacent support element by at least one lever arm such that the ledge halves are radially deflectable relative to the axis of the shaft thereby permitting removal and installation of the roller, said minor axis being of a length smaller than the inner diameter of the roller and the major axis being of a length greater than the inner diameter of the roller, and a protective tubular sheath to be placed over the roller having a projection received by the transverse slit to secure the sheath in place.

2. A fixture, as in claim 1 wherein the support elements and the second ledge have rounded borders.

3. A fixture, as in claim 1 wherein said shaft is a hollow cylinder.

4. A lint remover assembly comprising: a shaft having first and second spaced apart disc-shaped support members integral therewith for supporting an adhesive tape roll sleeve, the diameter of the support members being less than the inner diameter of the sleeve thereby allowing rotation of the sleeve, the support elements being spread apart a distance less than the length of the sleeve, a pair of ledge members for positioning the sleeve about the support members, the first of said ledge members having disc-shape and fixed on the shaft and positioned axially outward from the first support member, a handle integral with the first ledge member, the first ledge member having a dimension, radial with respect to the axis of the shaft, which is greater than the inner diameter of the sleeve and less than the outer diameter of the sleeve, the second ledge member fixed on an arm integral with the second support member such that the second ledge is positioned axially outward from the second support member, the second ledge extending radially outward a distance greater than the inner diameter and less than the outer diameter of the sleeve, the second ledge having a transverse slit dividing the ledge into two equal halves and extending through the arm a distance sufficient to allow radial deflection of the ledge halves thereby providing a snap lock engagement with the sleeve, a protective tubular sheath to be placed over the sleeve having an inward projection to be received by the transverse slit thereby securing the sheath in place.

5. A fixture for supporting adhesive coated roller used to remove lint from clothing comprising a shaft, at least one pair of disc-shaped support elements for the roller integral with said shaft and having a width less than the inner diameter of the roller and positioned apart from one another a distance less than the length of the roller and allowing rotational movement thereon, said disc-shaped support elements having a series of cuts on their edges that reduce the area of contact between the support elements to a series of spaced-apart points, a set of ledges positioned axially outside the support elements, the ledges having a dimension, radial with respect to the axis of the shaft which is greater than the inner diameter and less than the outer diameter of the roller, the first said ledges having a handle member integral therewith, the second ledge having a transverse slit dividing the ledge into two equal halves each of which is connected to the adjacent support element by at least one lever arm such that the ledge halves are radially deflectable relative to the axis of the shaft thereby permitting removal and installation of the roller, and a protective tubular sheath to be placed over the roller having a projection received by the transverse slit to secure the sheath in place.

6. A fixture for supporting adhesive coated rollers used to remove lint from clothing comprising a shaft, at least one pair of disc-shaped support elements for the roller integral with said shaft and having a width less than the inner diameter of the roller and positioned apart from one another a distance less than the length of the roller and allowing rotational movement thereon, a set of ledges positioned axially outside the support elements, the ledges having a dimension, radial with respect to the axis of the shaft, which is a width greater than the inner diameter and less than the outer diameter of the roller, the first of said ledges having a handle member integral therewith, the second ledge having a transverse slit dividing the ledge into two equal halves each of which is connected to the adjacent support element by at least one lever arm such that the ledge halves are radially deflectable relative to the axis of the shaft thereby permitting removal and installation of the roller, and a protective tubular sheath to be placed over the roller having an end wall provided with a projection extending axially toward the interior of the roller, said projection being received by the transverse slit to secure the sheath in place, said projection having a free end of enlarged cross section and said slit having edges which are undercut to accommodate said free end.

* * * * *